US005899385A

United States Patent [19]

Hofmann et al.

[11] Patent Number: 5,899,385

[45] Date of Patent: May 4, 1999

[54] FUEL INJECTION VALVE FOR INTERNAL COMBUSTION ENGINES

[75] Inventors: Karl Hofmann, Remseck; Johann Warga, Bietigheim-Bissingen; Thomas Kuegler, Neuss, all of Germany; Peter Kuegel; Gungor Yurtseven, both of Bursa, Turkey

[73] Assignee: Robert Bosch GmbH, Stuttgart, Germany

[21] Appl. No.: 08/874,518

[22] Filed: Jun. 13, 1997

[30] Foreign Application Priority Data

Jul. 21, 1995 [DE] Germany ..... 195 26 658
Jun. 13, 1996 [DE] Germany ..... 196 23 581

[51] Int. Cl.[6] ..... B05B 9/00

[52] U.S. Cl. ..... 239/124; 239/533.2; 239/533.9

[58] Field of Search ..... 239/124, 125, 239/127, 88, 90, 91, 96, 533.1–533.3, 533.9

[56] References Cited

U.S. PATENT DOCUMENTS

| | | | |
|---|---|---|---|
| 2,959,360 | 11/1960 | Nichols | 239/96 |
| 4,195,783 | 4/1980 | Hulsing | 239/533.3 |
| 4,423,715 | 1/1984 | Ecomard et al. | 239/88 |
| 4,465,237 | 8/1984 | Kupper | 239/533.3 |
| 4,570,853 | 2/1986 | Schmied | 239/533.3 |
| 4,758,169 | 7/1988 | Steiger | 239/96 |
| 4,846,114 | 7/1989 | List | 239/88 |
| 4,892,065 | 1/1990 | List | 239/533.3 |
| 5,445,323 | 8/1995 | Perr et al. | 239/91 |
| 5,765,755 | 6/1998 | Peters et al. | 239/124 |

FOREIGN PATENT DOCUMENTS

3928912 A1 4/1990 Germany .

*Primary Examiner*—Andres Kashnikow
*Assistant Examiner*—Lisa Ann Douglas
*Attorney, Agent, or Firm*—Edwin E. Greigg; Ronald E. Greigg

[57] ABSTRACT

A fuel injection valve for internal combustion engines that has a valve member which is guided axially displaceably in a guide bore of a valve body and which on an end toward the combustion chamber has a valve sealing face that cooperates with a valve seat face, formed on an end of the guide bore toward the combustion chamber, for controlling the communication between a high-pressure conduit in the valve body and at least one injection opening A diversion conduit in the valve member, by way of which diversion conduit the high-pressure conduit can be made to communicate with a relief chamber when the valve member has lifted from the valve seat face. Once the maximum opening stroke of the position of the valve member is reached, the diversion conduit is closed by a sealing face provided on the valve member, so that the entire supplied fuel quantity can attain injection.

13 Claims, 4 Drawing Sheets

FUEL INJECTION VALVE FOR INTERNAL COMBUSTION ENGINES

BACKGROUND OF THE INVENTION

The invention is based on a fuel injection valve for internal combustion engines. In one such fuel injection valve, known from German Offenlegungsschrift DE-OS 39 28 912, a valve member is guided axially displaceably in a guide bore of a valve body that protrudes by one end into the combustion chamber of the engine to be supplied. On its end toward the combustion chamber, the valve member has a valve sealing face, which cooperates with a valve seat formed on the end toward the combustion chamber of the guide bore. Adjoining the valve seat face in the direction remote from the combustion chamber is a fuel-carrying high-pressure conduit in the valve body, which is formed partly by an annular gap between the valve member shaft and the wall of the guide bore. Toward the combustion chamber, at least one injection opening adjoins the valve seat; the flow of fuel between the high-pressure conduit and the injection opening is opened up by the raising of the valve member from the valve seat.

For cooling the valve member, a diversion conduit is also provided in the valve member, by way of which the high-pressure conduit communicates continuously with a relief chamber when the valve member is lifted from the valve seat, and which is formed by a blind bore that begins toward the end of the valve member toward the combustion chamber and a transverse bore that intersects the blind bore. The transverse bore discharges into a diversion chamber formed between the valve member and the wall of the guide bore; this chamber is defined axially by an injection valve shim that rests on the valve body, and a through opening is provided in the shim in such a way that the diversion chamber communicates continuously with a relief chamber formed by the spring chamber of the injection valve.

This continuous communication, in the open position of the valve member, between the high-pressure conduit and the relief chamber has the disadvantage, however, that a relatively large amount of fuel flows out via the diversion conduit during the actual injection event and is thus unavailable for the fuel injection, which impairs the efficiency of the entire system. Moreover, because of the undefined amount of leakage at the diversion conduit, the quantity of fuel to be injected can be metered only very imprecisely, so that the known fuel injection valve does not meet the demands of modern internal combustion engines.

OBJECT AND SUMMARY OF THE INVENTION

The fuel injection valve according to the invention has the advantage over the prior art that the diversion conduit in the valve member is closed once the valve member reaches its opening stroke position. Thus in an advantageous way, a delay in the opening stroke motion of the valve member, which is necessary for good fuel preparation in the combustion chamber is attained without substantially affecting the accuracy of the injection quantity.

The embodiment of the diversion conduit as a longitudinal transverse bore which discharges at a ground face on the valve member shaft, has the advantage that such a valve member is simple to produce.

The production of the valve member may be done via a creative forming process, such as by sintering or the so-called metal-injection method. Alternatively, however, it is also possible to make the longitudinal and transverse bores mechanically or by erosion in a tube blank, optionally with a premachined external geometry, and to make the ground faces by metal-cutting methods.

Advantageously, via the geometry or design of the ground faces and the transverse bore, a defined diversion volume at the diversion chamber can be established; the portion of the diversion chamber formed between the ground faces and the wall of the guide bore then acts as a defined throttle cross section.

A further advantage is attained by providing a collar on the upper end, toward the shim, of the ground faces; the collar protrudes into a widened-cross section region of the guide bore and by way of it the sealing contact area between the valve member and the shim can be increased, so that with secure sealing the demands for component tolerances can be made less stringent with further decreases the production costs. The ground faces, preferably embodied as flat faces and forming part of the diversion chamber, may alternatively be embodied by radial plunge cuts on the valve member that connect the outlet openings of the transverse bores to the upper portion of the diversion chamber.

The fuel injection valve according to the invention functions as a valve that opens inward and can alternatively be embodied as a so-called seat-hole, blind-bore or pintle nozzle; the longitudinal bore of the diversion conduit, embodied as a blind bore, is disposed in such a way in the valve member, however, that in the closed state of the fuel injection valve it is closed relative to the engine combustion chamber.

In order to reliably avert the penetration of fuel gases into the diversion conduit when the injection valve is closed, the blind bore may be closed on its lower end, toward the combustion chamber. The communication with the high-pressure conduit then takes place via at least one radial bore, which leads away from the blind bore and discharges at the valve sealing face of the valve member. The outlet opening of this radial bore is preferably located upstream of the injection opening, advantageously between the injection opening and a seat edge at the valve member. This arrangement also has the advantage that when used in an injection valve with two valve springs, the radial bore is throttled in the prestroke region, and as a result, initially only little fuel is diverted (low pressure loss) via the diversion conduit, while in the second stroke phase until the maximum stroke stop is reached a large diversion quantity flows out, so that the effect of a so-called two-spring holder is reinforced.

Further advantages and advantageous features of the subject of the invention may be learned from the specification and the drawing.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
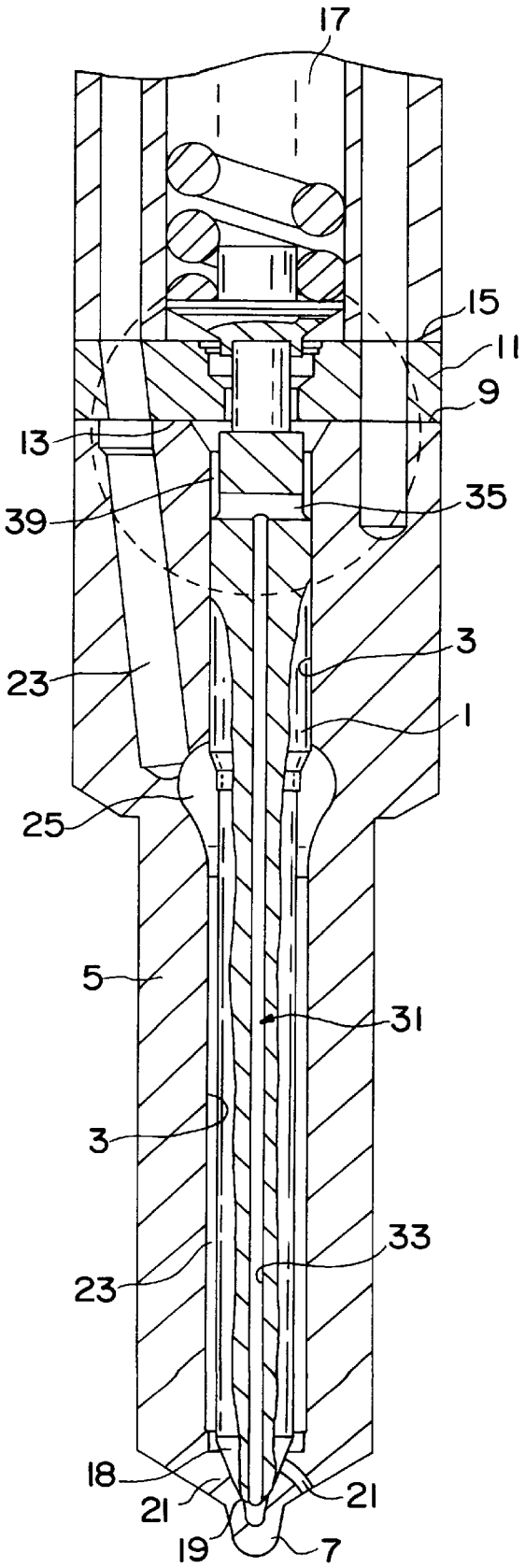
FIG. 1 is a longitudinal section through a first exemplary embodiment of the fuel injection valve.

In the first exemplary embodiment, shown in FIG. 1, of the fuel injection valve according to the invention for internal combustion engines, a pistonlike valve member 1 is axially displaceably guided in a guide bore 3 of a valve body 5. The cylindrical valve body 5 protrudes by one end 7 into the combustion chamber, not identified by reference numeral, of the engine to be supplied, and its other end, embodied as a flat end face 9, rests on a first end face 13 of a shim 11 of the injection valve; the second end face 15 of the shim, remote from the valve body 5, is adjoined by a relief chamber 17 which also forms a spring chamber 17, which receives a restoring spring, not identified by reference numeral, of the valve member 1 and which communicates continuously via a return line, also not shown, with a low-pressure fuel chamber and thus forms a relief chamber 17.

On its end toward the combustion chamber, the valve member 1 has a valve sealing face 18, which in the exemplary embodiment is formed as a conical sealing face and cooperates with a valve seat face 19, provided on the end toward the combustion chamber of the guide bore 3; this face is embodied as a hollow cone, while the guide bore 3 in the exemplary embodiment is in the form of a blind bore. Two injection openings 21 originate at the valve seat face 19 and discharge in the combustion chamber of the engine to be supplied. A high-pressure conduit 23 discharges at the end of the valve seat 19 remote from the injection opening 21; this conduit extends as a bore, beginning at the upper end face 9 of the valve body 5 and initially extends as far as a pressure chamber formed by a widening of diameter of the guide bore 3, and from there leads through an annular gap between the shaft of the valve member 1 and the wall of the guide bore 3 on as far as the valve seat 19. This high-pressure conduit 23 communicates in a manner not shown in further detail, by means of an injection line, with a high-pressure fuel pump that supplies the fuel injection valve with fuel that is at high pressure.

For a delayed opening stroke motion of the valve member 1, a diversion conduit 31 is also provided in the valve member 1; during the opening stroke motion of the valve member 1, this conduit enables communication between the high-pressure conduit 23 and the relief chamber 17.

Figure 2:
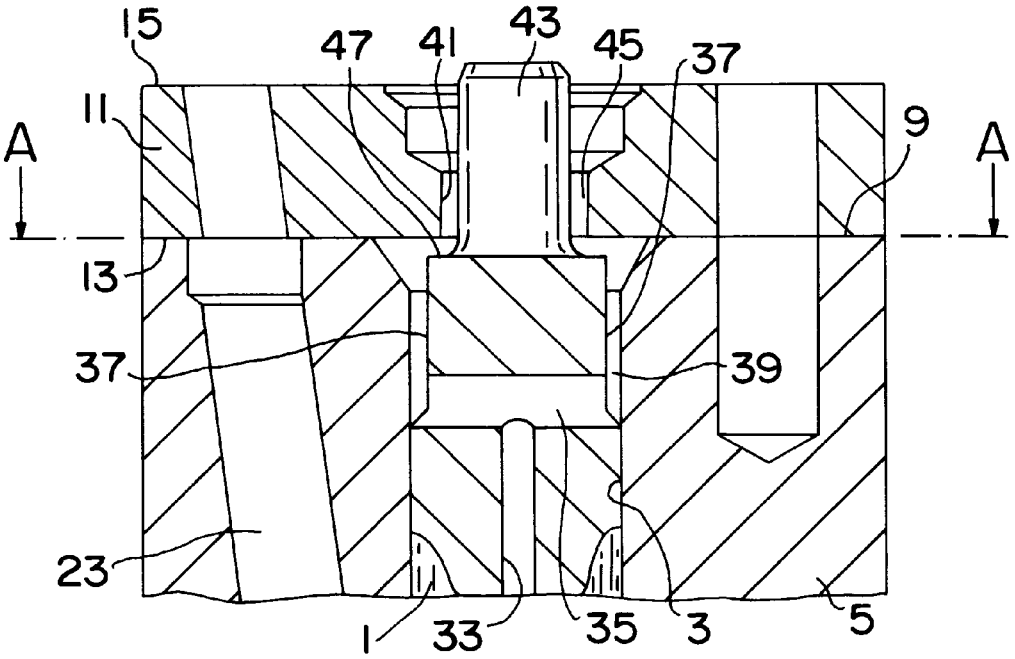
FIGS. 2 and 2*a* are a detail of FIG. 1 showing two views enlarged in the region of the diversion chamber.
Figure 2A:
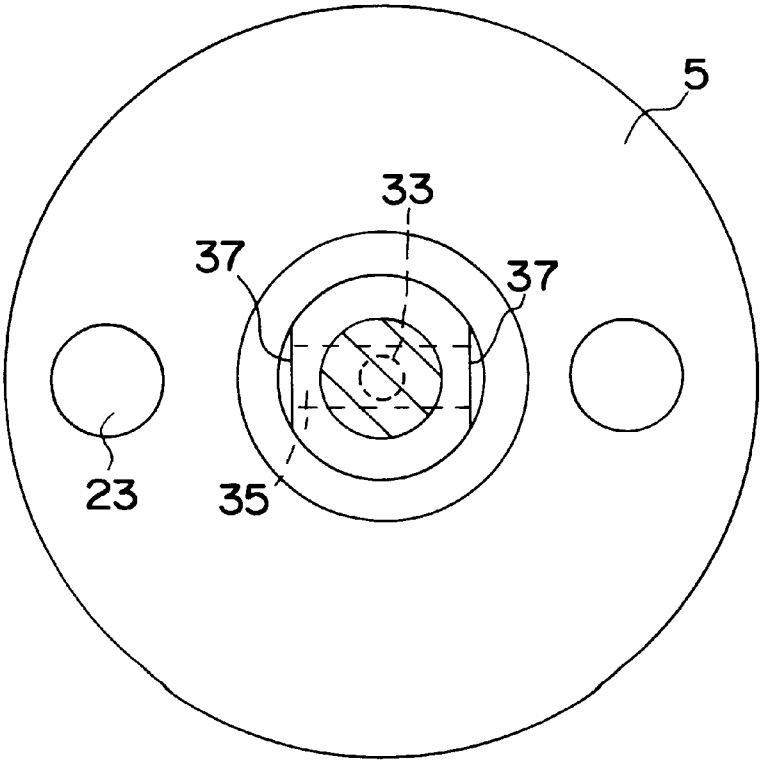

This diversion conduit 31, also shown on a larger scale in FIG. 2, is formed by a blind bore 33 that begins at the end of the valve member 1 toward the combustion chamber and protruding into the blind bore of the guide bore 3 and in the exemplary embodiment extends axially, and a transverse bore 35 that intersects it at the upper end of the valve member 1. In the region of the outlet openings of the transverse bore 35, the valve member 1 has two opposed flat ground faces 37 on its jacket face, and between them and the wall of the guide bore 3 a diversion chamber 39 is formed, whose flow cross section forms an adjustable throttle cross section. The diversion chamber 39 extends axially to the valve member 1 from a shoulder that defines the ground faces 37 in the direction of the injection opening 21 as far as the end face 13 of the shim 11; the diameter of the guide bore 3 increases conically on its end toward the shim 11.

The relief of the diversion chamber 39 is effected via a flow cross section 45, formed between a through bore 41 of the shim 11 and a reduced-diameter portion 43 of the shaft of the valve member 1, into the relief chamber 17; this flow cross section 45 can be closed, when the valve member 1 is entirely lifted from the valve seat 19, by means of an annular sealing face 47 of the valve member 1 formed at the transition to the reduced-diameter-shaft portion 43, by contact with the end face 13 of the shim 11. The diameter of the through bore 41 of the shim 11 is smaller than the outer diameter of the sealing face 47.

Figure 3:
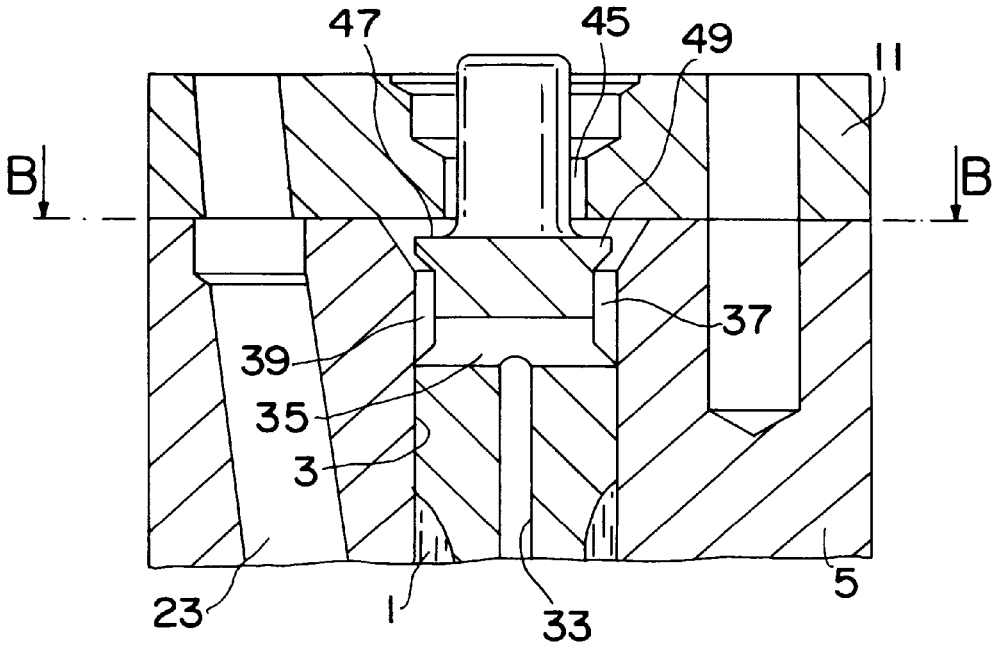
FIGS. 3 and 3*a* show a second exemplary embodiment analogous to FIGS. 2 and 2*a,* in which a collar on the ground faces is also provided.
Figure 3A:
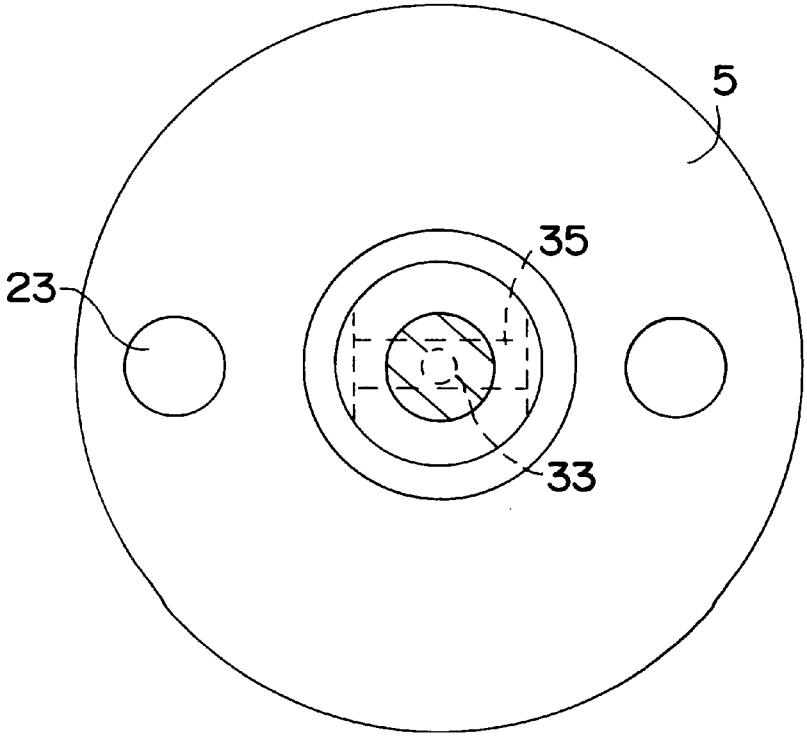

The second exemplary embodiment shown in FIGS. 3 and 3*a* differ from the first exemplary embodiment only in the geometry of the valve member in the region of the diversion chamber 39, and thus its description is limited to this portion of the injection valve.

The ground faces 37 in the second exemplary embodiment are defined toward the shim 11 by a collar 49, which protrudes into the portion of the guide bore 3 having a widened cross section and by which the radial length of the sealing face 47 on the valve member 1 is increased, so that with improved sealing, a larger flow cross section 45 between the diversion chamber 39 and the relief chamber is possible.

Figure 4:
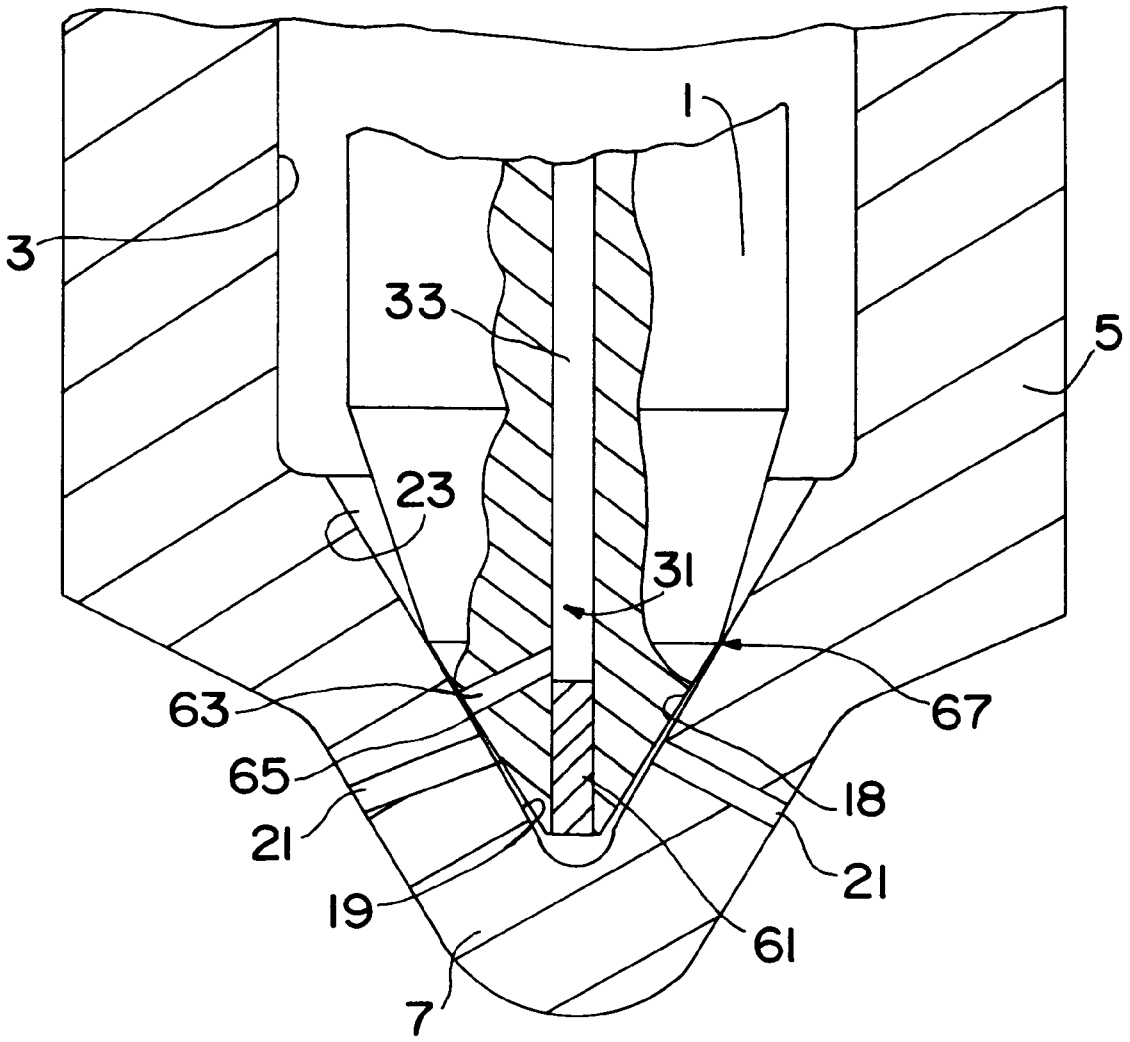
FIG. 4 shows a third exemplary embodiment in a view of the end of the fuel injection valve toward the combustion chamber, in which the blind bore of the diversion conduit is closed and communicates with the high-pressure conduit via a radial bore.

In the third exemplary embodiment, represented in FIG. 4 only by the lower portion 7, toward the combustion chamber, of the valve body 5 of the fuel injection valve, the blind bore 33 of the diversion conduit 31 is closed in the valve member 1, on its end toward the combustion chamber, by means of a stopper 61, but other closure options are alternatively possible as well. The communication between the diversion conduit 31 and the high-pressure conduit 23 is effected via a radial bore 63 that begins at the blind bore 33 and discharges into the valve sealing face 18 of the valve member 1. The outlet opening 65 formed at the valve sealing face 18 is located upstream of the injection opening 21 in the valve seat face. Moreover, the outlet opening is located downstream below a seat edge 67 of the valve member 1 that defines the conical valve sealing face 18 on the end remote from the combustion chamber and is formed by a change in the cone angle of the valve sealing face 18.

The mode of operation of the fuel injection valve according to the invention is as follows.

In the closed state, the valve member 1 is held with its valve sealing face 18 in contact with the valve seat face 19 by the restoring spring, so that the injection openings 21 are closed relative to the high-pressure conduit 23.

With the onset of the injection phase, fuel pumped by the high-pressure pump reaches the high-pressure conduit 23, and in a known manner displaces the valve member 1 away from the valve seat face 19, counter to the force of the restoring spring, so that the fuel which is at high pressure passes via the opened flow cross section between the valve sealing face 18 and the valve seat 19 into the blind bore of the guide bore 3 and via the injection openings 21 into the combustion chamber of the engine.

In this process, however, during the opening stroke motion of the valve member 1 some of the fuel flows out of the blind bore of the guide bore 3 via the diversion conduit 31 in the valve member 1 into the diversion chamber 39 and on via the flow cross section 45 out to the relief chamber 17, thus delaying the opening stroke motion of the valve member 1, which has an advantageous effect on the preparation of the fuel in the combustion chamber.

Once the maximum opening stroke position of the valve member 1 is reached, the flow cross section 45 connecting the diversion chamber 39 with the relief chamber 17 is closed by the contact of the sealing face 47 of the valve member 1 with the shim 11, so that now the entire supplied fuel quantity reaches the combustion chamber for injection.

The injection is terminated in a known manner by the drop in pressure in the high-pressure conduit 23, as a consequence of which the restoring spring displaces the valve member 1 back into contact with the valve seat 19. During the closing stroke motion of the valve member 1, some of the high-pressure fuel flows out of the blind bore via the diversion conduit 31, thus increasing the closing stroke speed.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A fuel injection valve for internal combustion engines, comprising a valve member (1) which is axially displaceably guided in a guide bore (3) of a valve body (5) and which on an end toward the combustion chamber has a valve sealing face (18) that cooperates with a valve seat face (19), formed on an end of the guide bore (3) toward the combustion chamber, for controlling the communication between a high-pressure conduit (23) in the valve body (5) and at least one injection opening (21), having a diversion conduit (31) in the valve member (1), by way of said diversion conduit the high-pressure conduit (23) can be made to communicate with a relief chamber (17) when the valve member (1) has lifted from the valve seat face (19), said diversion conduit is formed by a blind bore (33) that originates at an end toward the combustion chamber of the valve member (1) and at least one transverse bore (35) that intersects the blind bore (33), wherein the transverse bore (35) discharges into a diversion chamber (39) that is formed between the valve member (1) and the guide bore (3) and can be made to communicate with the relief chamber (17), the communication between the diversion chamber (39) and the relief chamber (17) is closed, in a maximum opening stroke position of the valve member (1), by a sealing face (47) provided on the valve member (1).

2. A fuel injection valve in accordance with claim 1, in which the sealing face (18) on the valve member (1) is embodied as an annular end face, which is formed at a cross-sectional reduction of the valve member (1), and a reduced-diameter portion (43) of the valve member protrudes with play into a through bore (41) of a shim (11) that axially contacts the valve body (5), the end face (13) toward the valve body (5) of the shim defining the diversion chamber (39), and a region of the end face (13) adjoining the through bore (41) forms a contact face for the sealing face (47) of the valve member (1).

3. A fuel injection valve in accordance with claim 2, in which an end face (15) of the shim (11) remote from the valve body (5), adjoins the relief chamber (17), which forms a spring chamber that receives a restoring spring of the valve member (1).

4. A fuel injection valve in accordance with claim 1, in which the diversion chamber (39) formed between a shaft of the valve member and the wall of the guide bore (3) is formed by at least one ground face (37) embodied as a flat face, on said shaft of the valve member (1), and the transverse bore (35) discharges into said diversion chamber (39).

5. A fuel injection valve in accordance with claim 4, in which two opposed ground faces (37) are provided on the shaft of the member (1), and an outlet opening of the transverse bore (35), embodied as a through bore, discharges into said diversion chamber.

6. A fuel injection valve in accordance with claim 2, in which the guide bore (3) widens conically on an end adjoining the shim (11).

7. A fuel injection valve in accordance with claim 1, in which the diversion chamber (39) is defined on an end of said value member toward a shim (11), by a collar (49) on said value member, whose annular face toward the shim (11) forms the sealing face (47) of the valve member (1).

8. A fuel injection valve in accordance with claim 1, in which a flow cross section of the diversion chamber (39) forms a defined throttle cross section.

9. A fuel injection valve in accordance with claim 1, in which the valve member (1) is produced by means of a creative forming metal-injection method.

10. A fuel injection valve in accordance with claim 1, in which the blind bore (33) is closed on an end toward the combustion chamber, and that at least one bore (63), which discharges in a region of the valve sealing face (18), leads away from the blind bore (33).

11. A fuel injection valve in accordance with claim 10, in which an outlet opening (65) of the bore (63) of the blind bore (33) is located in the valve sealing face (18) upstream of the injection opening (21) in the valve seat face (19).

12. A fuel injection valve in accordance with claim 11, in which the outlet opening (65) of the bore (63) of the blind bore (33) is located in the valve sealing face (18) between the injection opening (21) of the valve seat face (19) and a seat edge (67) on the valve member (1) that defines the valve sealing face (18) on an end of the valve sealing face remote from the combustion chamber.

13. A fuel injection valve in accordance with claim 10, in which the blind bore (33) is closed on an end toward the combustion chamber by a stopper (61).

* * * * *